US005938467A

United States Patent [19]

Savage, Jr.

[11] Patent Number: 5,938,467

[45] Date of Patent: Aug. 17, 1999

[54] LOCKING HEADER AND PIN ASSEMBLY

[76] Inventor: John M. Savage, Jr., 538-B Via De La Valle, Solana Beach, Calif. 92075

[21] Appl. No.: 08/971,288

[22] Filed: Nov. 17, 1997

[51] Int. Cl.[6] ..... H01R 13/627

[52] U.S. Cl. ..... 439/358

[58] Field of Search ..... 439/358, 357, 439/590

[56] References Cited

U.S. PATENT DOCUMENTS

| | | | |
|---|---|---|---|
| 3,706,954 | 12/1972 | Krafthefer | 439/357 |
| 4,418,976 | 12/1983 | Lenzini | 439/358 |
| 5,186,645 | 2/1993 | Bixler | 439/358 |

*Primary Examiner*—Steven L. Stephan
*Assistant Examiner*—Javaid Nasri
*Attorney, Agent, or Firm*—William W. Haefliger

[57] ABSTRACT

A locking header and circuit terminal pin assembly, comprising in combination, a header (10) having a first portion **(10*a*) configured to be supported by a circuit board (14) at a side thereof, the header having a second portion (10*b*) carried by the first portion, the first portion defining an opening (11) into which the pin (12) a receivable so that the pin also extends adjacent one side of the header second portion in installed position; and a connector (21) carried by the pin to have detent connection to the header upper portion, and operating to lock the connector in installed position. A header protrusion (27)** extends in elongated relation to the connector.

14 Claims, 4 Drawing Sheets

LOCKING HEADER AND PIN ASSEMBLY

BACKGROUND OF THE INVENTION

This invention relates generally to devices for mounting electrical components, and more particularly to such devices which connect terminal pins to circuit boards.

There is great need for simple, effective, economical, and reliable apparatus to securely mount electrical components on or to circuit boards. There is also need for devices of this nature which are capable of positioning components having different numbers of pin type leads projecting toward the circuit board for electrical connection to circuitry on the board, and in the simple, effective manner as is now afforded by the present invention.

SUMMARY OF THE INVENTION

Basically the device of the invention includes a locking header and pin assembly that preferably comprises:

a) a header having a first portion configured to be supported by a circuit board on a side thereof, the header having a second portion carried by the first portion, the first portion defining an opening into which the pin is receivable so that the pin also extends adjacent one side of the header second portion in installed position, b) and a connector carried by the pin to have detent connection to the header second portion, and operating to lock the connector in installed position.

As will be seen, the header second portion typically has flexure connection to the header first portion to allow resiliently yieldably flexing of the header second portion relative to the header first portion, in response to engagement with the connector during endwise assembly of the connector onto the pin.

Another object is to provide a connector having a cam surface in interference alignment with the header second portion, to deflect the header second portion during endwise assembly of the connector onto the pin. The header and connector typically have locking shoulders that come into registration following camming deflection of the header second portion, thereby to block upward removal of the connector. The connector preferably has a sideward projection on which are carried the cam surface and locking shoulder.

Yet another object is to provide multiple of such header second portions extending in a row and spaced apart from one another, the header second portions being individually capable of flexing, and multiple of the openings extending in a row on the header first portions.

Yet another object is to provide a header first portion having a primary shoulder to support the header on a circuit board, said primary shoulder located at a primary side of the header first portion which is opposite said header second portion, and said header first portion has a secondary shoulder at a secondary side of the header first portion to alternately support the header on a circuit board with said header second portion then projecting generally parallel to a plane defined by the circuit board. The header advantageously has L-shape, as will appear.

Electrical circuitry is typically provided at the opposite side of the circuit board, and electrically connected to the pin, or a row of such pins.

These and other objects and advantages of the invention, as well as the details of an illustrative embodiment, will be more fully understood from the following specification and drawings, in which:

DRAWING DESCRIPTION

DETAILED DESCRIPTION

Figure 1:
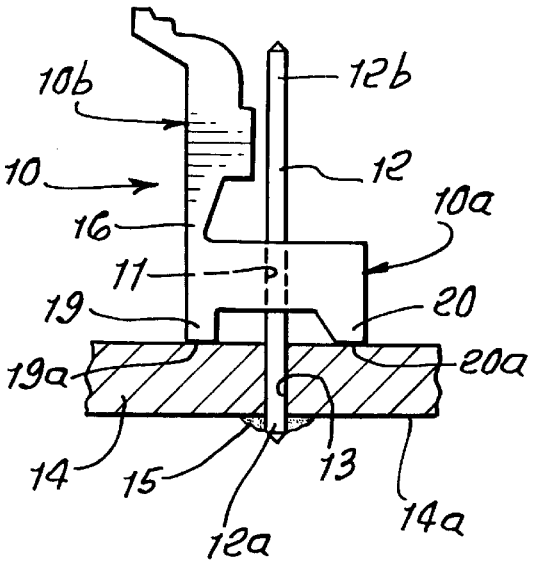
FIG. 1 is an elevation, partly on section, showing a header on a circuit board, and a connector pin received by the header and by the board.

In FIG. 1 a header 10 has a first or lower portion 10*a* defining a through opening 11. A pin 12 is received downwardly through the opening 11, and also through an opening 13 in a circuit board 14. The lower end 12*a* of the pin, in installed position, is electrically connected via wave soldering 15 to electrical circuitry at the lower side 14*a* of the board 14. The upper portion 12*b* of the pin projects upwardly of header lower portion 10*a*, and laterally of upwardly projecting header upper portion 10*b*. The header may have L-shape in cross-section, as shown; and a reduced thickness, flexure pivot connection at 16, connecting the header second or upper portion 10*b* to the header first or lower portion 10*a*, to allow resiliently yieldable flexing of the second or upper portion (see arrow 17) relative to the lower portion in response to force application to the header upper portion as indicated by arrow 18 in FIG. 4. Header lower portion also has legs 19 and 20, that may be suitably attached to the circuit board, or otherwise supported thereon. The legs define a shoulder or shoulders 19*a* and 20*a* to support the header on the circuit board, and at the side of the header portion 10*a* opposite the header portion 10*b*.

Figure 2:
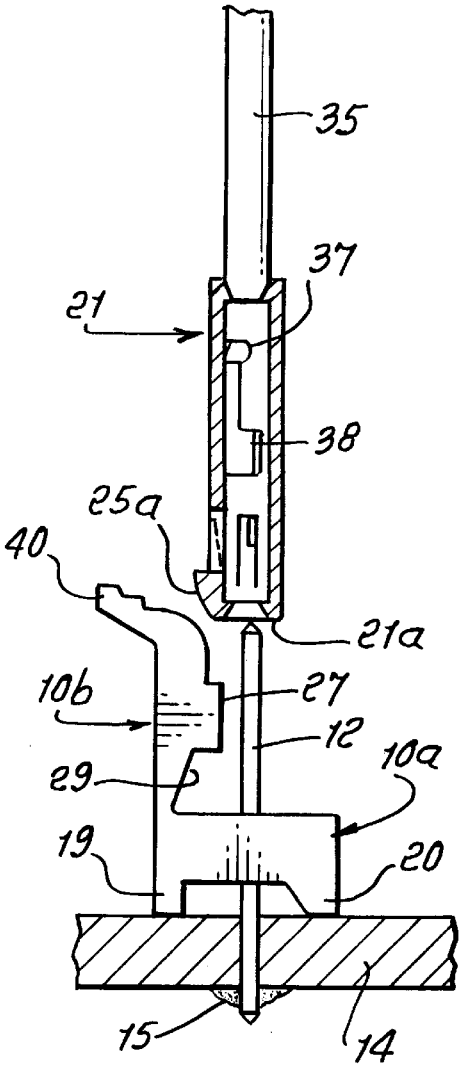
FIG. 2 is a view like FIG. 1, but also showing a connector aligned with the pin to be received by the pin and header.
Figure 3:
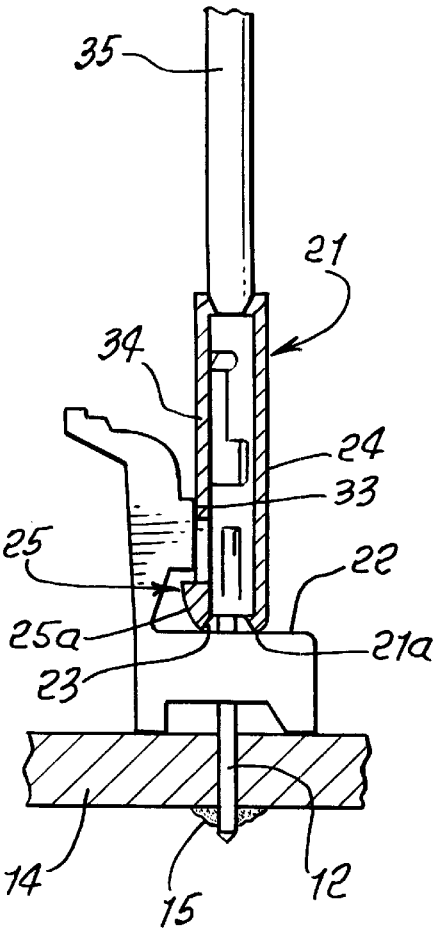
FIG. 3 is a view like FIG. 2, and showing the connector in downwardly received position, on the pin and header.
Figure 4:
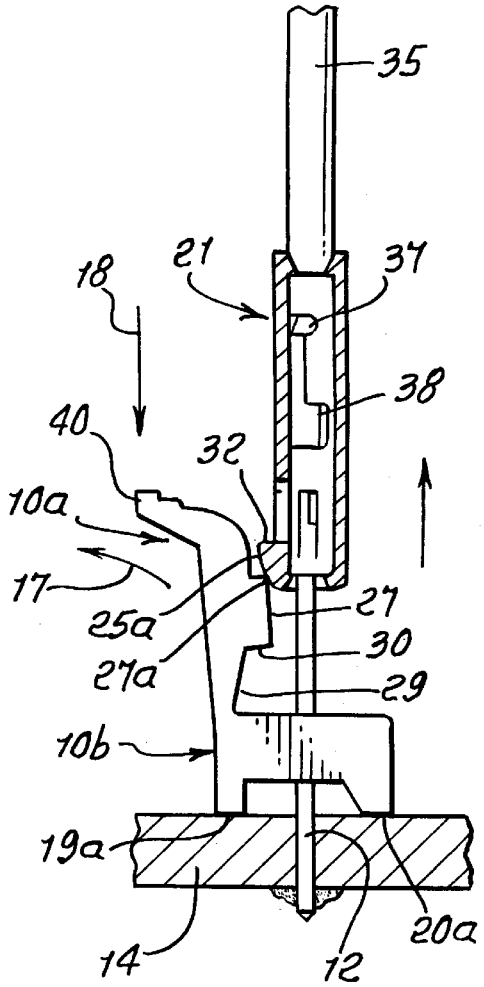
FIG. 4 is a view like FIG. 3, but showing the header deflected, and the connector in upwardly released position.

A connector 21 shown above the pin in FIG. 2, is installed downwardly to be carried by the pin, as seen in FIG. 3. The connector has a lowermost end wall 21*a* that engages the top surface 22 of the header lower portion to limit such downward installation. The connector is guided downwardly by the pin that projects upwardly into the connector via an opening 23 in wall 21*a*, the connector having a sleeve wall at 24. A protrusion 25 proximate the lower end of the connector has interference engagement with the header upper portion, causing resiliently yieldable flexing of the latter, as referred to above. In the example as shown in FIG. 4, the protrusion 25 has a downwardly tapering and convex cam surface 25*a* that in FIG. 2 has interference alignment with the rightward projection 27 on the header upper portion 10*a*, so that the cam surface may engage the upper edge 27*a* of that projection to deflect the header upper portion leftwardly during downward assembly of the connector onto the pin. Note the notch 29 in the header upper portion, below the protrusion 27.

The header and connector also have locking shoulders that come into registration following camming deflection of said header upper portion, thereby to block upward removal of the pin from said opening. The locking shoulder on the header is seen at 30, facing downwardly above notch 29; and the locking shoulder on the connector is seen at 32 on the protrusion 25, and facing upwardly. As the shoulder 32 passes below lateral registration with shoulder 30, the header upper portion flexes rightwardly into FIG. 3 position, wherein shoulder 30 extends above shoulder 32, locking the connector in FIG. 3 position, with the protrusion 25 partly in the notch 29. Also, rightward wall 33 of the header upper portion engages the sleeve wall 34.

Note wire lead 35 positioned to be received endwise downwardly into the connector 21, for retention at connector tangs 37 and 38. The electrical conductivity of the connector electrically connects the wire lead to the pin.

FIG. 4 shows a finger lever 40 integral with the header upper portion 10*b*, and projecting leftwardly. This enables downward pressure on the finger to cause leftward flexing of the connector upper portion, to release the detent connection of the connector to the header, releasing the connector for upward withdrawal, as seen in FIG. 4.

Figure 5:
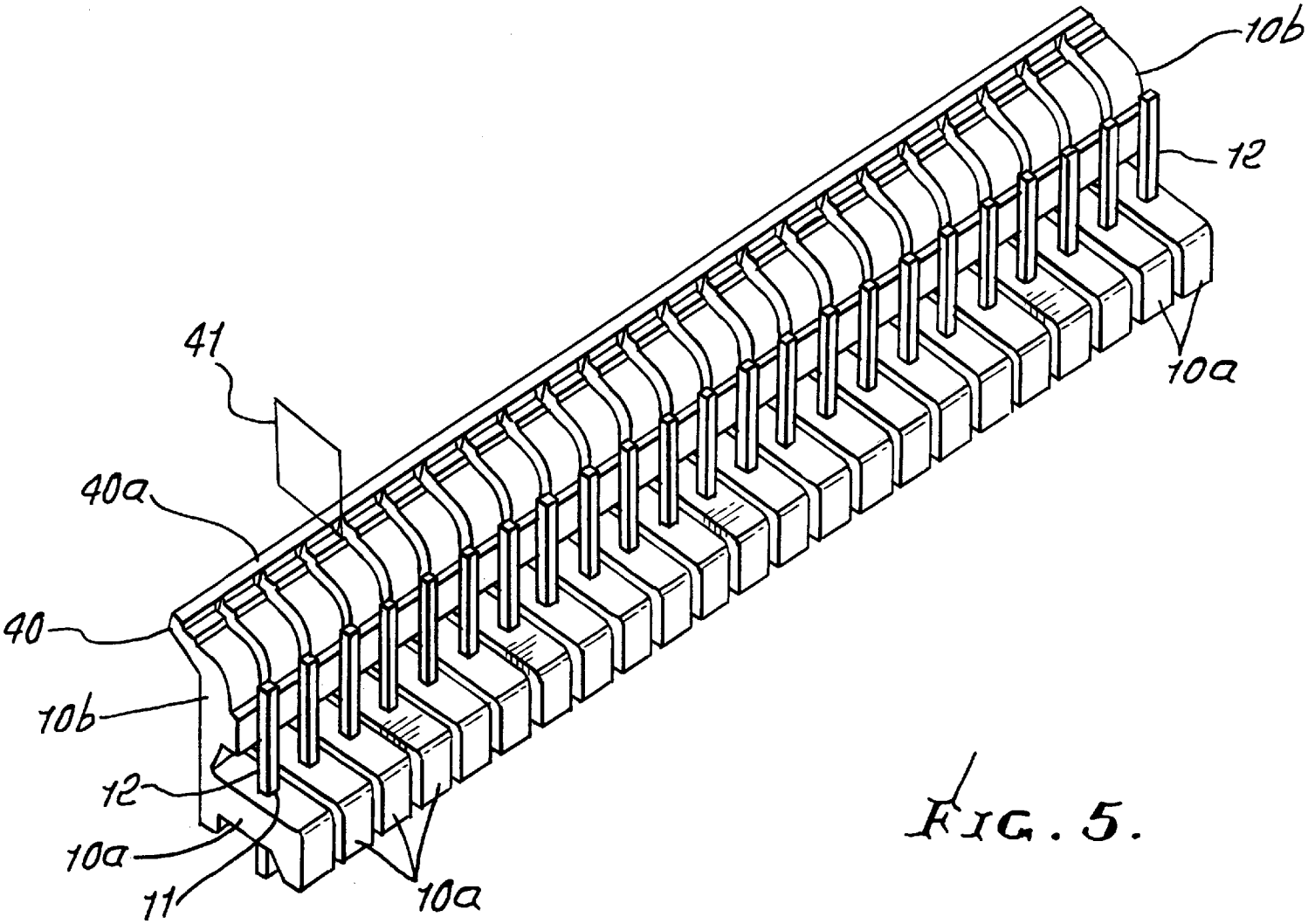
FIG. 5 is a perspective view showing a row of integrated headers and pins.

FIG. 5 shows multiple such header upper portions 10*b* extending in a row and spaced apart from one another so as to allow independent flexing of the header upper portions 10*a* as described. Multiple pins 12 are also shown, as extending through the openings 11, in the connector lower portion 10*a*.

In FIG. 5, the spaced finger levers 40 are gang interconnected as at 40*a* along lever tips, as in molded condition. Also, the lower rear portions of spaced headers 10*a* are gang interconnected. This enables or facilitates cut-off of a selected number of header units 10, for use as required. For example, if four interconnected units are required for a particular installation, a cut may be made at plane 41, to separate four units which are gang interconnected as indicated. During use, force application to the levers 40 deflects all four of them, in unison, to allow disconnection of four connectors 21 from four pins 12.

Figure 6:
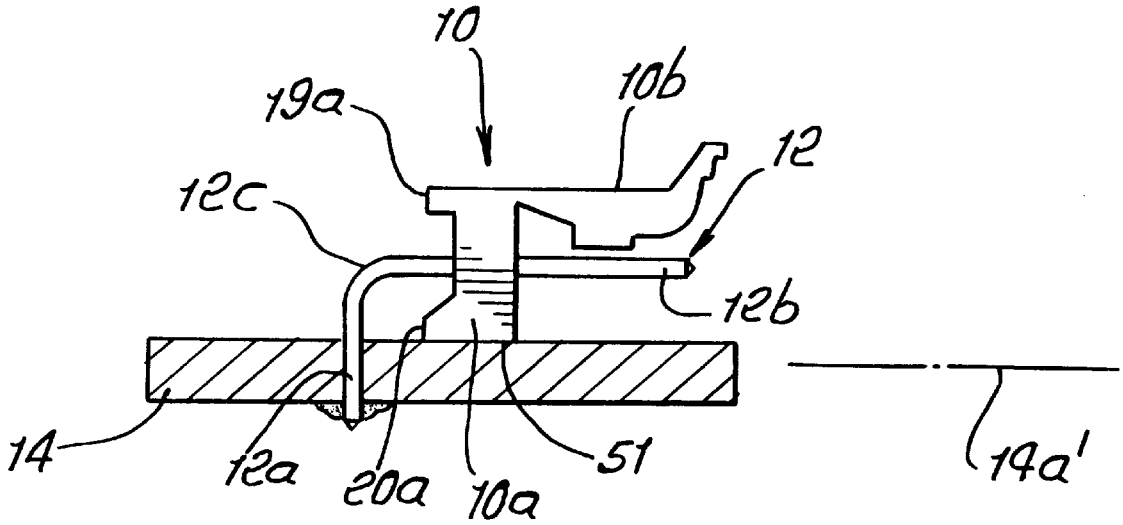
FIG. 6 is a view like FIG. 1, but showing an alternate installed position of the header.
Figure 7:
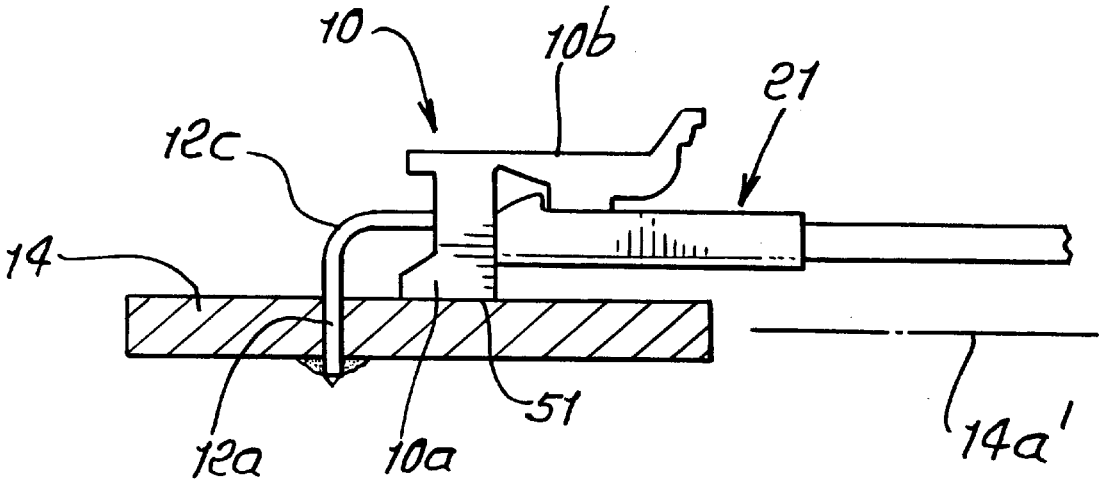
FIG. 7 is like FIG. 6, and showing a connector installed on the header.

FIGS. 6 and 7 show the header 10 in an alternate position, relative to the circuit board 14, i.e. the header is shown rotated 90° relative to the plane 14*a* of the circuit board. In this position, primary shoulders 19*a* and 20*a* extend perpendicular to the plane 14*a*, and secondary shoulder 51 on a side of header portion 10*a* extends parallel to plane 14*a*. Therefore, the header has dual installation use advantage.

Pin 12 in FIGS. 6 and 7 has L-shape, as shown. Pin leg 12*a* extends at 90° relative to leg 12*b*; leg 12*a* extends normal to plane 14*a*, and leg 12*b* extends parallel to plane 14*a*. In FIG. 7, the connector 21 has been assembled endwise to the pin leg 12*b*, as in FIG. 3. A pin bend appears at 12*c*.

From the above it will be clear that the header second portion has a protrusion spaced from said header locking shoulder and defining a surface for engaging the side of the connector in spaced relation to said locking shoulders, said surface being elongated in substantially parallel relation to the side of the connector, and defining an elongated camming surface to be lengthwise progressively engaged by said connector cam surface during said camming deflection of said header second portion

I claim:

1. A locking header and circuit terminal pin assembly, comprising in combination a) said header having a first portion configured to be supported by a circuit board at a side thereof, said header having a second portion carried by said first portion, said first portion defining an opening into which the pin is receivable so that the pin also extends adjacent one side of said header second portion in installed position, b) and a connector for engagement with the pin and to have detent connection to said header second portion, and operating to lock the connector in said installed position, c) said header second portion having flexure connection to said header first portion to allow resiliently yieldably flexing of a said second portion relative to the header first portion in response to engagement with said connector during endwise assembly of the connector onto said pin, d) said connector having a cam surface in interference alignment with said header second portion to deflect said header second portion during said endwise assembly of the connector onto the pin, e) said header and said connector having locking shoulders that come into registration following camming deflection of said header second portion, thereby to block endwise removal of the connector off the pin, f) said header second portion having a protrusion spaced from said header locking shoulder and defining a surface for engaging the side of the connector in spaced relation to said locking shoulders, said surface being elongated in substantially parallel relation to the side of the connector, and defining an elongated camming surface to be lenghtwise progressively engaged by said connector cam surface during said camming deflection of said header second portion.

2. The combination of claim 1 wherein the locking shoulder on said connector is spaced endwise of said cam surface on the connector.

3. The combination of claim 1 wherein said connector has releasable attachment to said pin.

4. The combination of claim 1 including electrical circuitry at the opposite side of said board and electrically connected to said pin.

5. The combination of claim 1 including a finger on the header second portion and projecting to facilitate flexing of the header second portion in response to pressure application on the finger, thereby to release said detent connection.

6. The combination of claim 1 wherein said header first portion has a shoulder to support the header on the circuit board, said shoulder located at a side of the header first portion which is opposite said header second portion.

7. The combination of claim 1 wherein said header first portion has a shoulder to support the header on the circuit board with said header second portion then projecting generally parallel to a plane defined by the circuit board.

8. The combination of claim 1 wherein said header first portion has a primary shoulder to support the header on the circuit board, said primary shoulder located at a primary side of the header first portion which is opposite said header second portion, and said header first portion has a secondary shoulder at a secondary side of the header first portion to alternately support the header on the circuit board with said header second portion then projecting generally parallel to a plane defined by the circuit board.

9. The combination of claim 2 wherein the connector has a sideward projection on which are carried said cam surface and locking shoulder on the connector.

10. The combination of claim 3 including a wire lead also attached to said connector to have electrical connection to said pin.

11. The combination of claim 8 wherein said primary and secondary shoulders extend at substantially 90° relative to one another.

12. The combination of claim 11 wherein said header has L-shaped.

13. The combination of claim 12 wherein said pin has L-shape with a first pin portion extending generally parallel to said plane and a second pin portion extending generally normal to said plane.

14. A multiple locking header and circuit terminal pin assembly, comprising in combination:

a) each header having a first portion configured to be supported by a circuit board at a side thereof, said header having a second portion carried by said first portion said first portion defining an opening into which the pin is receivable so that the pin also extends adjacent one side of said header second portion in installed, b) and a connector for engagement with the pin and have detent connection to said header second portion, and operating to lock the connector in said installed portion, c) and wherein multiple of said header second portions extend in a row and spaced apart from one another, and multiple of said openings extend in a row, said header second portions having extremities that are spaced apart, and gang interconnected by elongated bridging structure and adapted to be severed at selected locations.

* * * * *